US012163729B2

(12) United States Patent
Zhu et al.

(10) Patent No.: US 12,163,729 B2
(45) Date of Patent: Dec. 10, 2024

(54) SHELF ASSEMBLY FOR REFRIGERATOR AND REFRIGERATOR

(71) Applicants: QINGDAO HAIER REFRIGERATOR CO., LTD., Qingdao (CN); HAIER SMART HOME CO., LTD., Qingdao (CN)

(72) Inventors: Xiaobing Zhu, Qingdao (CN); Xueli Cheng, Qingdao (CN); Zhenxing Zhang, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 22 days.

(21) Appl. No.: 18/016,329

(22) PCT Filed: Jul. 12, 2021

(86) PCT No.: PCT/CN2021/105690
§ 371 (c)(1),
(2) Date: Jan. 13, 2023

(87) PCT Pub. No.: WO2022/012457
PCT Pub. Date: Jan. 20, 2022

(65) Prior Publication Data

US 2023/0280089 A1 Sep. 7, 2023

(30) Foreign Application Priority Data

Jul. 13, 2020 (CN) ..... 202010667412.6

(51) Int. Cl.
*F25D 25/02* (2006.01)
*A47B 57/00* (2006.01)
(Continued)

(52) U.S. Cl.
CPC ..... *F25D 25/02* (2013.01); *A47B 57/52* (2013.01); *F25D 23/066* (2013.01); *A47B 57/06* (2013.01);
(Continued)

(58) Field of Classification Search
CPC ..... F25D 25/02; F25D 25/024; F25D 25/04; F25D 23/066; F25D 23/067;
(Continued)

(56) References Cited

U.S. PATENT DOCUMENTS 7,337,730 B2 * 3/2008 Bienick ..... F25D 25/02 108/108
8,226,184 B2 * 7/2012 Kang ..... A47B 57/06 312/319.1
(Continued)

FOREIGN PATENT DOCUMENTS

CN 104344675 A 2/2015
CN 104374143 A 2/2015
(Continued)

*Primary Examiner* — Kimberley S Wright
(74) *Attorney, Agent, or Firm* — Cheng-Ju Chiang

(57) ABSTRACT

A shelf assembly for a refrigerator and a refrigerator are provided. The shelf assembly comprises: a shelf device for placing articles; a slide rail forming a slideway in a vertical direction, and having at least two positioning portions in a vertical direction; wherein the shelf assembly further comprises: a moving device for supporting the shelf device, the moving device comprising a bearing plate that is operably moved upward and downward relative to the slide rail, and a locking plate rotatably disposed relative to the bearing plate, a positioning member being disposed on the locking plate, the locking plate engaging with the shelf device; when the shelf device is operably lifted or released, a positioning member is disengaged from or engaged with one of the positioning portions, to adjust the height of the shelf device.
(Continued)

Adjustment of the shelf device is simple and convenient and the cost is lower.

18 Claims, 15 Drawing Sheets

(51) Int. Cl.

| | |
|---|---|
| ***A47B 57/52*** | (2006.01) |
| ***A47B 96/02*** | (2006.01) |
| ***F25D 23/06*** | (2006.01) |
| *A47B 57/06* | (2006.01) |
| *A47B 96/06* | (2006.01) |
| *F25D 25/04* | (2006.01) |

(52) U.S. Cl.
CPC ..... *A47B 96/028* (2013.01); *A47B 96/061* (2013.01); *F25D 23/067* (2013.01); *F25D 25/024* (2013.01); *F25D 25/04* (2013.01); *F25D 2325/021* (2013.01)

(58) Field of Classification Search
CPC ... F25D 2325/021; A47B 57/52; A47B 57/06; A47B 96/028; A47B 96/061
See application file for complete search history.

(56) References Cited

U.S. PATENT DOCUMENTS

| | | | | |
|---|---|---|---|---|
| 2005/0204966 | A1* | 9/2005 | Bienick | A47B 57/48 248/220.21 |
| 2010/0060125 | A1* | 3/2010 | Kang | A47B 57/06 312/408 |
| 2013/0081421 | A1 | 4/2013 | Kwon et al. | |
| 2018/0128538 | A1* | 5/2018 | Jang | A47B 57/30 |

FOREIGN PATENT DOCUMENTS

| | | | |
|---|---|---|---|
| CN | 204574689 | U | 8/2015 |
| CN | 106382787 | A | 2/2017 |
| CN | 109764623 | A | 5/2019 |
| CN | 111380316 | A | 7/2020 |
| CN | 111380318 | A | 7/2020 |
| EP | 0619464 | A1 | 10/1994 |
| WO | 2018/202364 | A1 | 11/2018 |

* cited by examiner

SHELF ASSEMBLY FOR REFRIGERATOR AND REFRIGERATOR

CROSS REFERENCE TO RELATED APPLICATIONS

The present invention is a 35 U.S.C. § 371 National Phase conversion of International (PCT) Patent Application No. PCT/CN2021/105690, filed on Jul. 12, 2021, which claims benefit of Chinese Application No. 202010667412.6, filed on Jul. 13, 2020, the disclosure of which is incorporated by reference herein. The PCT International Patent Application was filed and published in Chinese.

TECHNICAL FIELD

The present invention relates to a shelf assembly for a refrigerator and a refrigerator.

BACKGROUND

In daily life, people mainly use a refrigerator to refrigerate and store food, so a magnitude of a capacity ratio of the interior of the refrigerator is one of very important indices of the refrigerator. The capacity ratio is equal to a ratio of a space in the interior of the refrigerator in which articles can actually be placed to a total space of the interior of the refrigerator. To further increase the capacity ratio of the refrigerator, generally shelves are disposed on an inner side of the refrigerator door, so that food may be placed in the shelves and the capacity ratio of the refrigerator be improved.

In present-day mainstream refrigerator structures, a plurality of liner ribs having a fixed height and disposed vertically are usually provided on an inner side of the refrigerating compartment of the refrigerator. Shelves are disposed at heights corresponding to the liner ribs, so that the shelves are disposed vertically and spaced apart a certain distance. The shelves may be used to store more food. However, the heights of the shelves are fixed and invariable due to limitation of the positions of the liner ribs. Therefore, when high articles need to be placed on the shelves, they, limited by the distance between the shelves, have to be placed transversely in the shelves, thereby occupying a substantial portion of the internal space of the shelves, and, a very large portion of the upper space is wasted, thereby substantially reducing the utilization rate of the space in the refrigerator.

The shelves of refrigerators currently available in the market are almost all placed on liner ribs at fixed positions. Whenever the height of a shelf needs to be adjusted, the user always needs to remove the shelf from the liner ribs, and then placed on other liner ribs. At this time, the articles on the shelf have to be removed to adjust the height of the shelf. Therefore, the process of adjusting the height of the shelf is troublesome, and the operation is extremely inconvenient.

To solve the above problem, technicians have conducted constant research and developed an electrically-adjustable shelf for the refrigerator. This technique achieves convenient adjustment of the shelf, but the structure is too complicated and the cost is very high. In addition, although there are other adjustment structures, the shelf, when adjusted downward, might slide down in a free-fall manner, which is very dangerous.

SUMMARY

An object of the present invention is to provide a shelf assembly for a refrigerator and a refrigerator, which makes the adjustment of a shelf device simple and convenient and makes the cost lower.

To achieve one of the above objects, an embodiment of the present invention provides a shelf assembly for a refrigerator, the shelf assembly comprising a shelf device for placing articles; a slide rail forming a slideway in a vertical direction, and having at least two positioning portions in a vertical direction; wherein the shelf assembly further comprises a moving device for supporting the shelf device, the moving device comprising a bearing plate that is operably moved upward and downward relative to the slide rail, and a locking plate rotatably disposed relative to the bearing plate, a positioning member being disposed on the locking plate, the locking plate engaging with the shelf device; when the shelf device is operably lifted or released, a positioning member is disengaged from or engaged with one of the positioning portions, to adjust the height of the shelf device.

As a further improvement of embodiments of the present invention, the locking plate is rotatably connected with the bearing plate through a rotating shaft, the locking plate is provided with an upper hanger and a lower hanger, the shelf device comprises a support, and the support is provided with an upper position-limiting hole matting with the upper hanger and a lower position-limiting hole mating with the lower hanger; when the shelf device is lifted, the support drives the locking plate to rotate so that the positioning member is disengaged from the positioning portion.

As a further improvement of embodiments of the present invention, the upper position-limiting hole comprises a horizontal portion extending in a horizontal direction and a vertical portion extending in a vertical direction, the horizontal portion extends from the vertical portion in a direction facing towards the user, the lower position-limiting hole extends in the vertical direction, the upper position-limiting hole and the lower positioning-limiting hole are both set to be open-ended, and the upper position-limiting hole and the lower positioning-limiting hole both open downward.

As a further improvement of embodiments of the present invention, a distance from the rotating shaft to the lower hanger is greater than the distance from the rotating shaft to the upper hanger.

As a further improvement of embodiments of the present invention, a triangle is defined by a center of the rotating shaft, a center of the upper hanger and a center of the lower hanger.

As a further improvement of embodiments of the present invention, the bearing plate is provided with an arc-shaped guide hole, which guides the lower hanger.

As a further improvement of embodiments of the present invention, the moving device comprises two rolling bearings located in the slideway.

As a further improvement of embodiments of the present invention, the rolling bearings employ noise-free bearings.

To achieve one of the above objects, another embodiment of the present invention further provides a refrigerator, comprising a cabinet and a door body for opening/closing the cabinet, the cabinet comprising a housing and a liner, the liner defining a storage chamber, the refrigerator further comprising a shelf assembly disposed on the liner, the shelf assembly comprising: a shelf device comprising a shelf plate for placing articles; a slide rail being disposed on the liner and forming a slideway in the vertical direction, and having at least two positioning portions in the vertical direction;

wherein the shelf assembly further comprises a moving device for supporting the shelf device, the moving device comprises a bearing plate that is operably moved upward and downward relative to the slide rail, and a locking plate rotatably disposed relative to the bearing plate, a positioning member is disposed on the locking plate, and the locking plate engages with the shelf device; when the shelf device is operably lifted or released, the positioning member is disengaged from or engaged with one of the positioning portions, to adjust the height of the shelf device.

To achieve one of the above objects, a further embodiment of the present invention further provides a refrigerator, comprising a cabinet and a door body for opening/closing the cabinet, the cabinet defining a storage chamber, the refrigerator further comprising a shelf assembly disposed on the door body, the shelf assembly comprising: a shelf device comprising a bottle seat for containing articles; a slide rail being disposed on the door body and forming a slideway in a vertical direction, and having at least two positioning portions in the vertical direction; wherein the shelf assembly further comprises a moving device for supporting the shelf device, the moving device comprises a bearing plate that is operably moved upward and downward relative to the slide rail, and a locking plate rotatably disposed relative to the bearing plate, a positioning member is disposed on the locking plate, and the locking plate engages with the shelf device; when the shelf device is operably lifted or released, the positioning member is disengaged from or engaged with one of the positioning portions, to adjust the height of the shelf device.

As compared with the prior art, advantageous effects of the present invention are as follows: when the shelf device is lifted, the locking plate rotates relative to the bearing plate, so that the positioning member is disengaged from the positioning portion, and then the shelf device can be moved up or down to adjust the height. When the shelf device is moved to a desired height, it will not be lifted again. The locking plate rotates in a direction opposite to the above direction relative to the bearing plate, so that the positioning member engages with the corresponding positioning portion, thereby locking the shelf device at a certain height. Therefore, the adjustment of the shelf device is simple and convenient, and the cost is low.

An object of the present invention is to provide a shelf assembly for a refrigerator and a refrigerator, which enable the shelf device to move slowly and safely, and provide a better user experience effect.

To achieve one of the above objects, an embodiment of the present invention provides a shelf assembly for a refrigerator, the shelf assembly comprising: a shelf device for placing articles; a slide rail forming a slideway in a vertical direction, and having at least two positioning portions in vertical direction; the shelf assembly further comprises a moving device for supporting the shelf device, a height of the shelf device in the vertical direction being operably adjusted, the slide rail being provided with a rack extending in the vertical direction, the moving device comprising a gear engaging with the rack and a damper that generates damping against the rotation of the gear in one of the directions; when the moving device moves downward, the damper intervenes in damping to cause the moving device to fall slowly; when the moving device moves upward, the damper does not intervene in damping.

As a further improvement of embodiments of the present invention, the moving device further comprises a bearing plate that is operably moved upward and downward relative to the slide rail, and a locking plate rotatably disposed relative to the bearing plate, the gear is rotatably disposed relative to the bearing plate, a positioning member is disposed on the locking plate, and the locking plate engages with the shelf device; when the shelf device is operably lifted or released, a positioning member is disengaged from or engaged with one of the positioning portions, to adjust the height of the shelf device.

As a further improvement of embodiments of the present invention, the locking plate is rotatably connected with the bearing plate through a rotating shaft, the locking plate is provided with an upper hanger and a lower hanger, the shelf device comprises a support, and the support is provided with an upper position-limiting hole matting with the upper hanger and a lower position-limiting hole mating with the lower hanger; when the shelf device is lifted, the support drives the locking plate to rotate so that the positioning member is disengaged from the positioning portion.

As a further improvement of embodiments of the present invention, the upper position-limiting hole comprises a horizontal portion extending in a horizontal direction and a vertical portion extending in a vertical direction, the horizontal portion extends from the vertical portion in a direction facing towards the user, the lower position-limiting hole extends in the vertical direction, the upper position-limiting hole and the lower positioning-limiting hole are both set to be open-ended, and the upper position-limiting hole and the lower positioning-limiting hole both open downward.

As a further improvement of embodiments of the present invention, a distance from the rotating shaft to the lower hanger is greater than the distance from the rotating shaft to the upper hanger.

As a further improvement of embodiments of the present invention, the bearing plate is provided with an arc-shaped guide hole, which guides the lower hanger.

As a further improvement of embodiments of the present invention, the moving device comprises a mounting base fixedly connected to the bearing plate, the damper is disposed on the mounting base, and a gear shaft of the gear is connected to the damper.

As a further improvement of embodiments of the present invention, the moving device further comprises an elastic member urging the positioning member to engage with the positioning portion.

To achieve one of the above objects, another embodiment of the present invention further provides a refrigerator, comprising a cabinet and a door body for opening/closing the cabinet, the cabinet comprising a housing and a liner, the liner defining a storage chamber, the refrigerator further comprising a shelf assembly disposed on the liner, the shelf assembly comprising: a shelf device comprising a shelf plate for placing articles; a slide rail being disposed on the liner and forming a slideway in the vertical direction, and having at least two positioning portions in the vertical direction; wherein the shelf assembly further comprises a moving device for supporting the shelf device, a height of the shelf device in the vertical direction is operably adjusted, the slide rail is provided with a rack extending in the vertical direction, the moving device comprises a gear engaging with the rack and a damper that generates damping against the rotation of the gear in one of the directions; when the moving device moves downward, the damper intervenes in damping to cause the moving device to fall slowly; when the moving device moves upward, the damper does not intervene in damping.

To achieve one of the above objects, a further embodiment of the present invention further provides a refrigerator, comprising a cabinet and a door body for opening/closing the cabinet, the cabinet defining a storage chamber, the refrigerator further comprising a shelf assembly disposed on the door body, the shelf assembly comprising: a shelf device comprising a bottle seat for containing articles; a slide rail being disposed on the door body and forming a slideway in a vertical direction, and having at least two positioning portions in the vertical direction; wherein the shelf assembly further comprises a moving device for supporting the shelf device, a height of the shelf device in the vertical direction is operably adjusted, the slide rail is provided with a rack extending in the vertical direction, the moving device comprises a gear engaging with the rack and a damper that generates damping against the rotation of the gear in one of the directions; when the moving device moves downward, the damper intervenes in damping to cause the moving device to fall slowly; when the moving device moves upward, the damper does not intervene in damping.

As compared with the prior art, advantageous effects of the present invention are as follows: with the damper generating one-way damping being provided, it is ensured that left and right sides of the shelf device can move synchronously during upward movement and downward movement. Furthermore, the damper does not intervene in damping upon upward movement, the shelf device can be moved upward more easily, thereby improving the user's experience effect. In addition, when the shelf device and the moving device move downward, the damper intervenes in damping, increases resistance so that it cannot occur that the shelf device slides downward fast in a free-fall manner, such that the shelf device moves down slowly, and the user's experience in use can be improved.

DETAILED DESCRIPTION

The present invention will be described in detail in conjunction with specific embodiments shown in the figures. However, these embodiments are not intended to limit the present invention. Structural, methodological or functional variations made by those having ordinary skill in the art according to these embodiments are all included in the protection scope of the present invention. In the depictions of detailed embodiments of the present invention, the orientation or positional relationship indicated by terms such as "up", "down", "front", "rear", "left", "right", "vertical", "horizontal", "bottom", "in" and "out" etc. is the orientation or positional relationship based on the drawings, usually when a shelf assembly is in a normally-used state, and does not indicate that the specified positions or elements must have a specific orientation.

Figure 1:
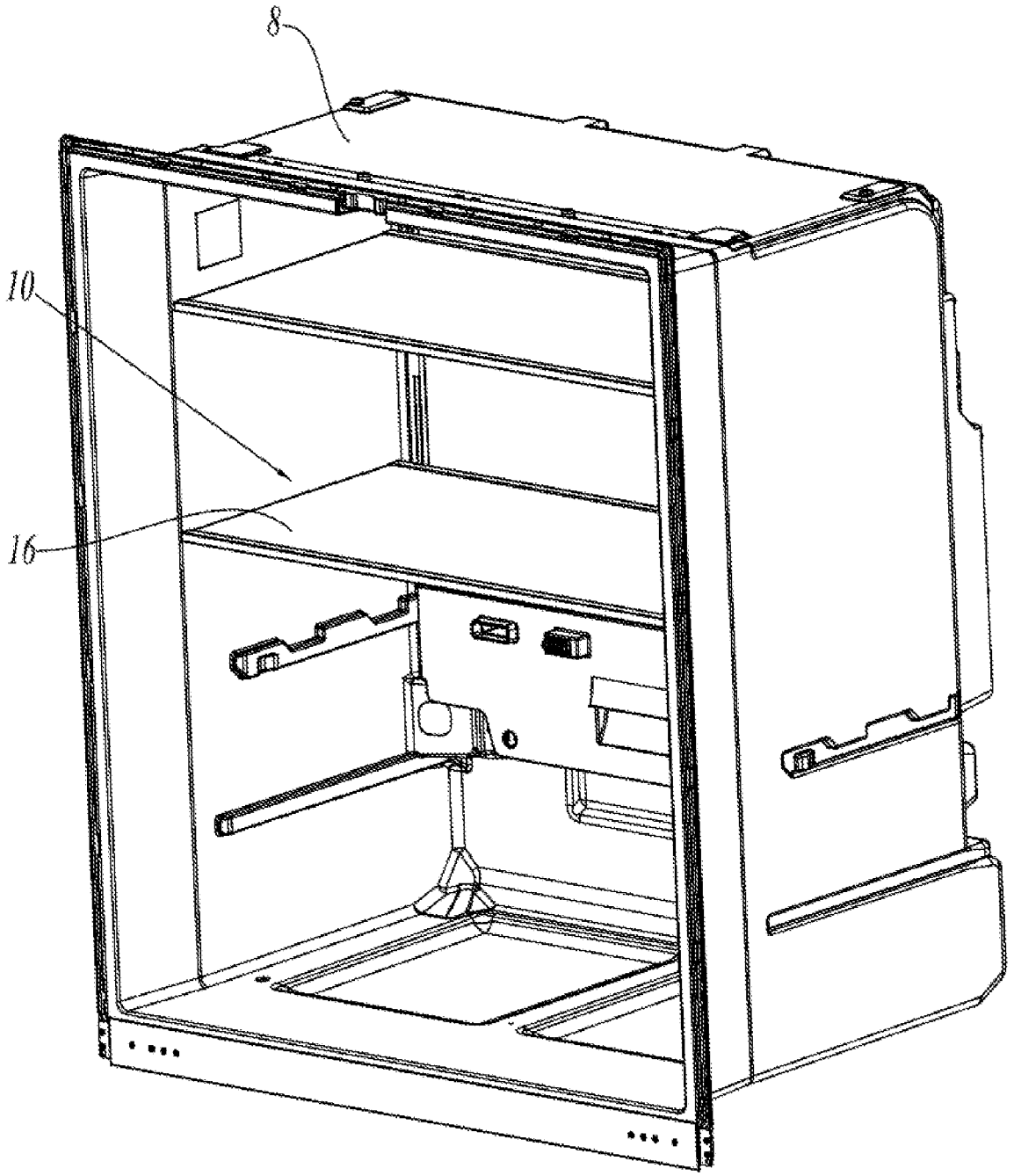
FIG. 1 is a perspective view of a refrigerator in a specific embodiment of the present invention.
Figure 2:
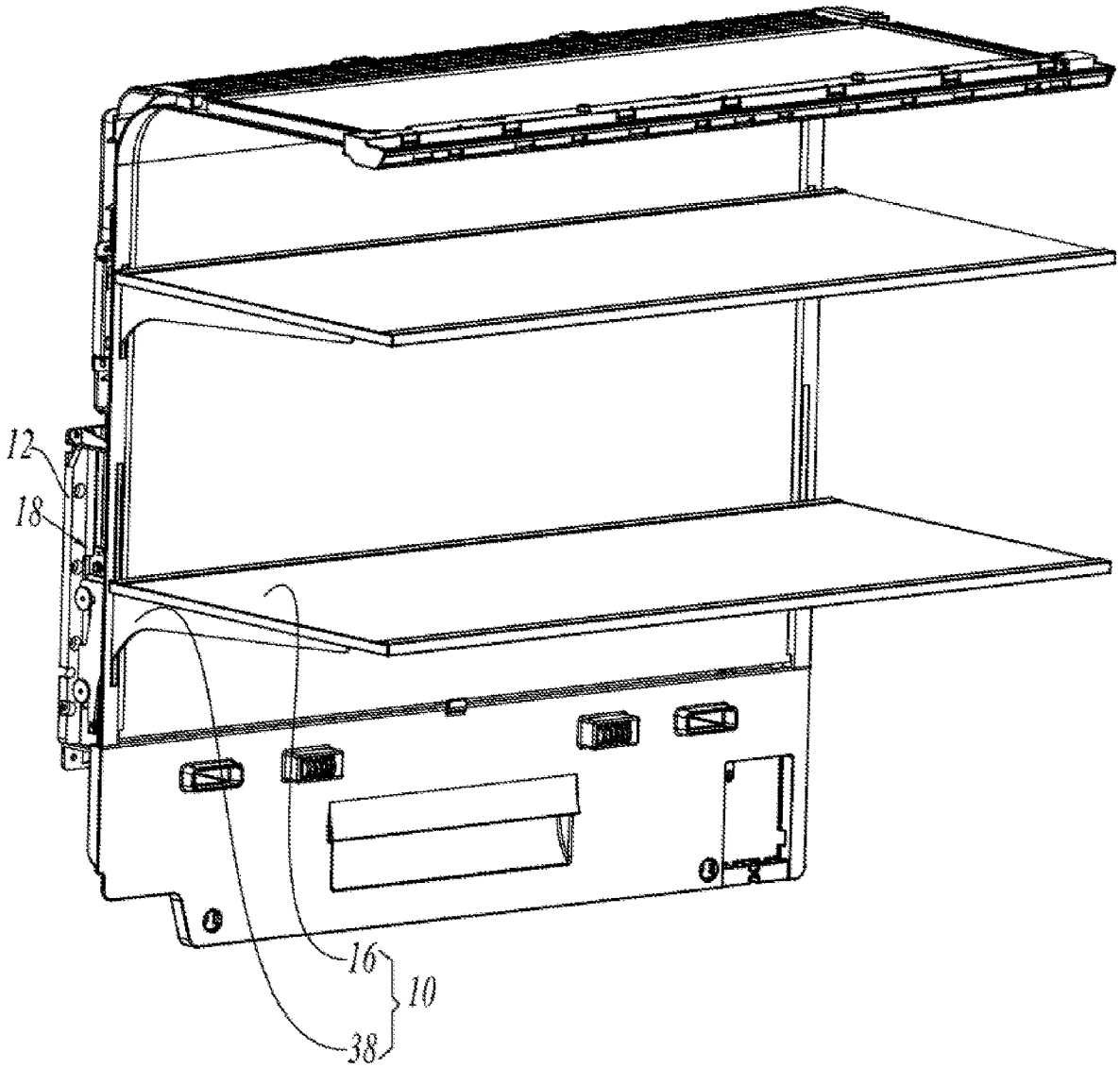
FIG. 2 is a perspective view of part of a liner and a shelf assembly in FIG. 1.
Figure 3:
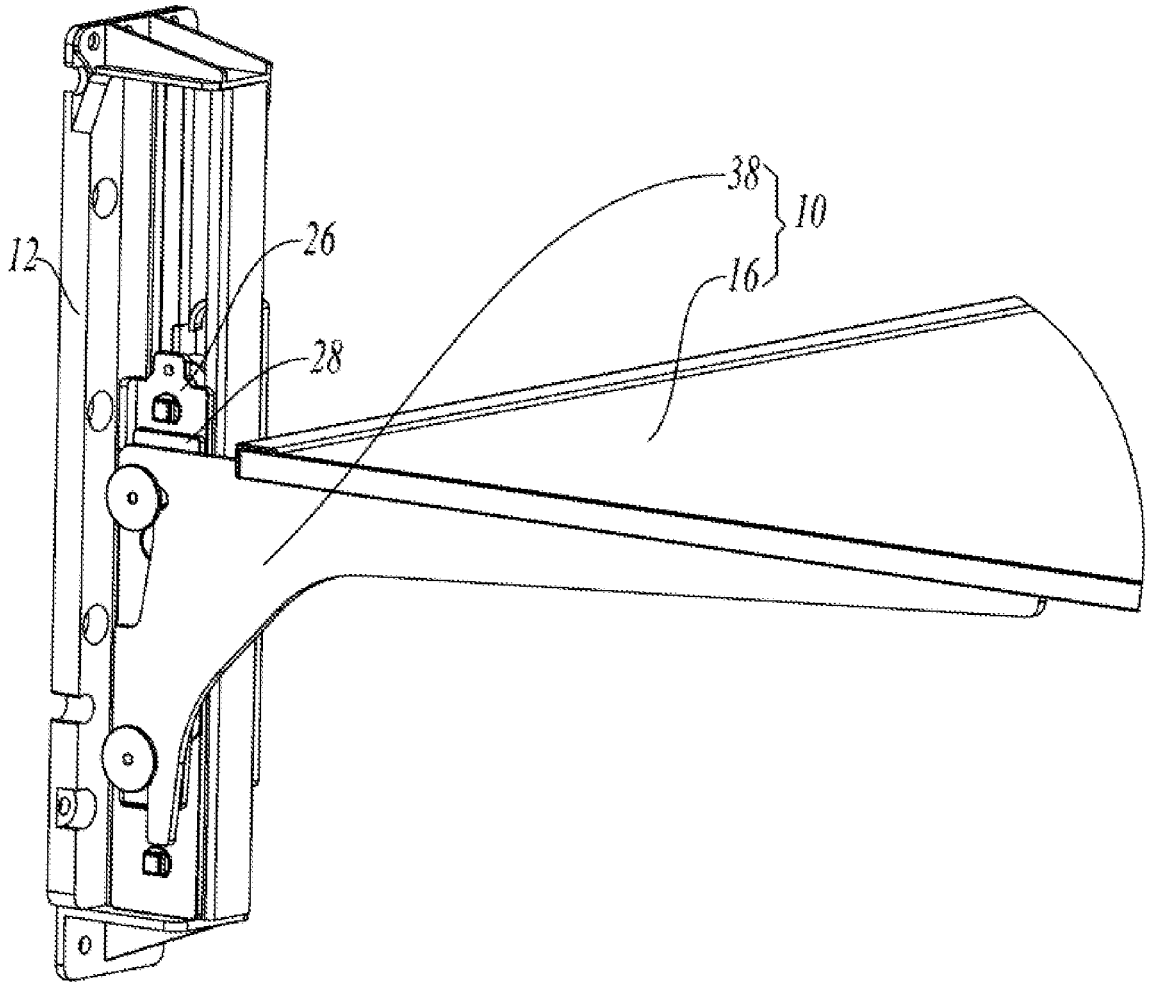
FIG. 3 is a partially enlarged perspective view of the shelf assembly of FIG. 2.
Figure 4:
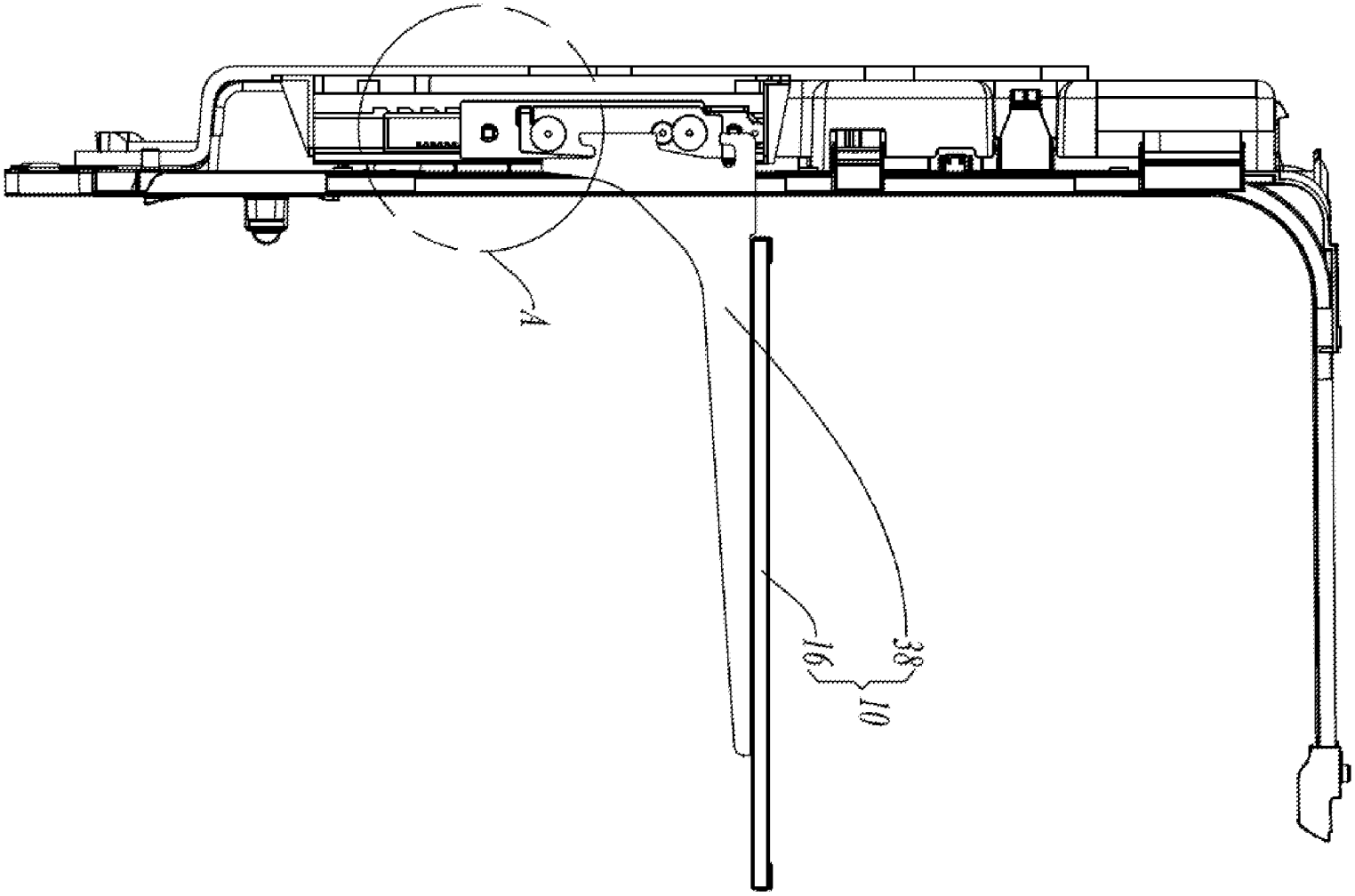
FIG. 4 is a right view of part of the liner and the shelf assembly in FIG. 1.
Figure 5:
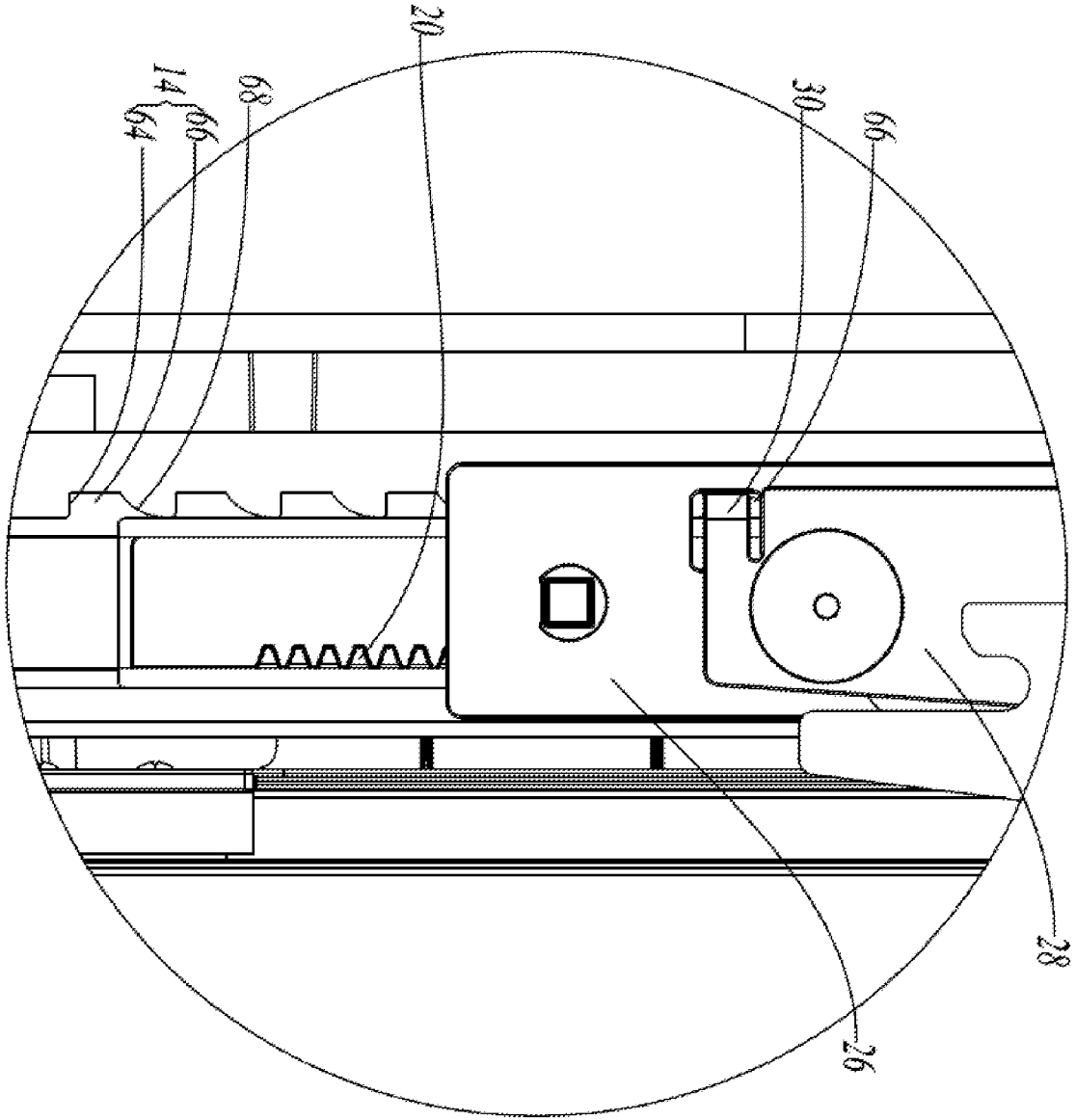
FIG. 5 is partially enlarged view of position A in FIG. 4.

As shown in FIG. 1 through FIG. 5, a specific embodiment of the present invention discloses a refrigerator. The refrigerator comprises a cabinet and a door body for opening/closing the cabinet. The cabinet comprises a housing and a liner 8 which defines a storage compartment. The refrigerator further comprises a shelf assembly. The shelf assembly comprises a shelf device 10 for placing articles and a slide rail 12. The slide rail 12 forms a slideway in a vertical direction, and has at least two positioning portions 14 in vertical direction.

Specifically, in the preferred embodiment, the shelf assembly is disposed on the liner 8. When the shelf assembly is disposed on the liner 8, the shelf device 10 comprises a shelf plate 16 for placing articles, whereupon the shelf plate 16 is usually a flat plate; The slide rail 12 is disposed on the liner 8 and forms a slideway in the vertical direction, and has at least two positioning portions 14 in the vertical direction.

Certainly, the shelf component may also be disposed on the door body. When the shelf assembly is disposed on the liner 8, the shelf device 10 comprises a bottle seat for containing articles. The bottle seat usually has receiving cavities for receiving articles, and the opening direction of the receiving cavities is usually upward; at this time, the slide rail 12 is disposed on the door body and forms a slideway in the vertical direction, and has at least two positioning portions 14 in the vertical direction.

Figure 6:
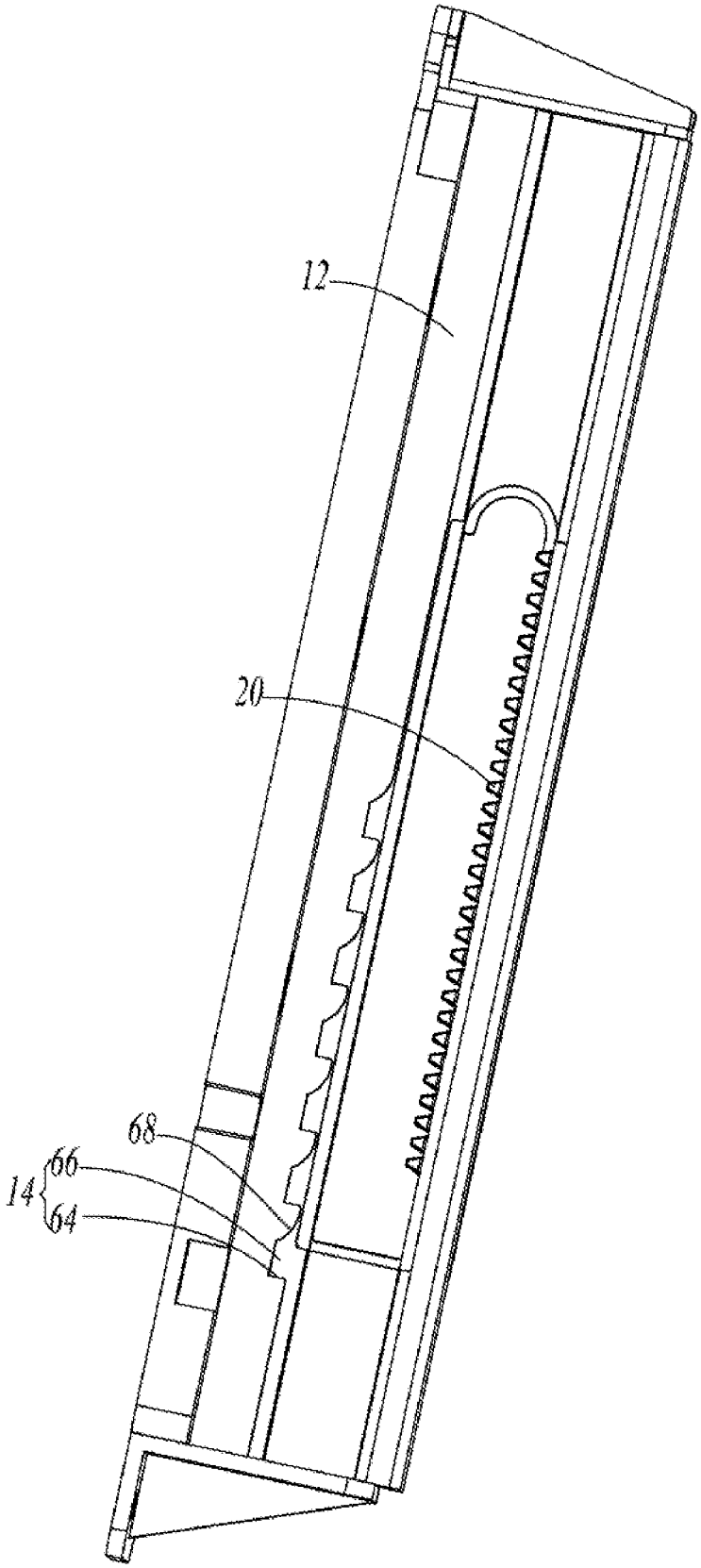
FIG. 6 is a perspective view of a slide rail in the shelf assembly in FIG. 3.
Figure 7:
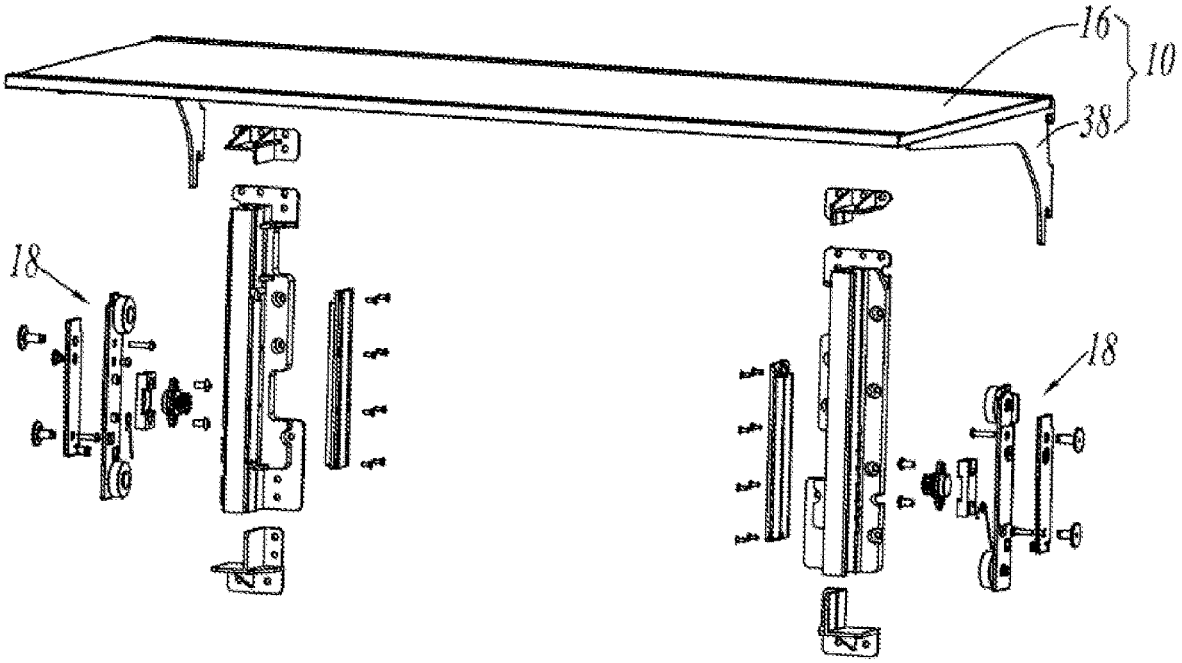
FIG. 7 is an exploded perspective view of the shelf assembly in FIG. 3.
Figure 8:
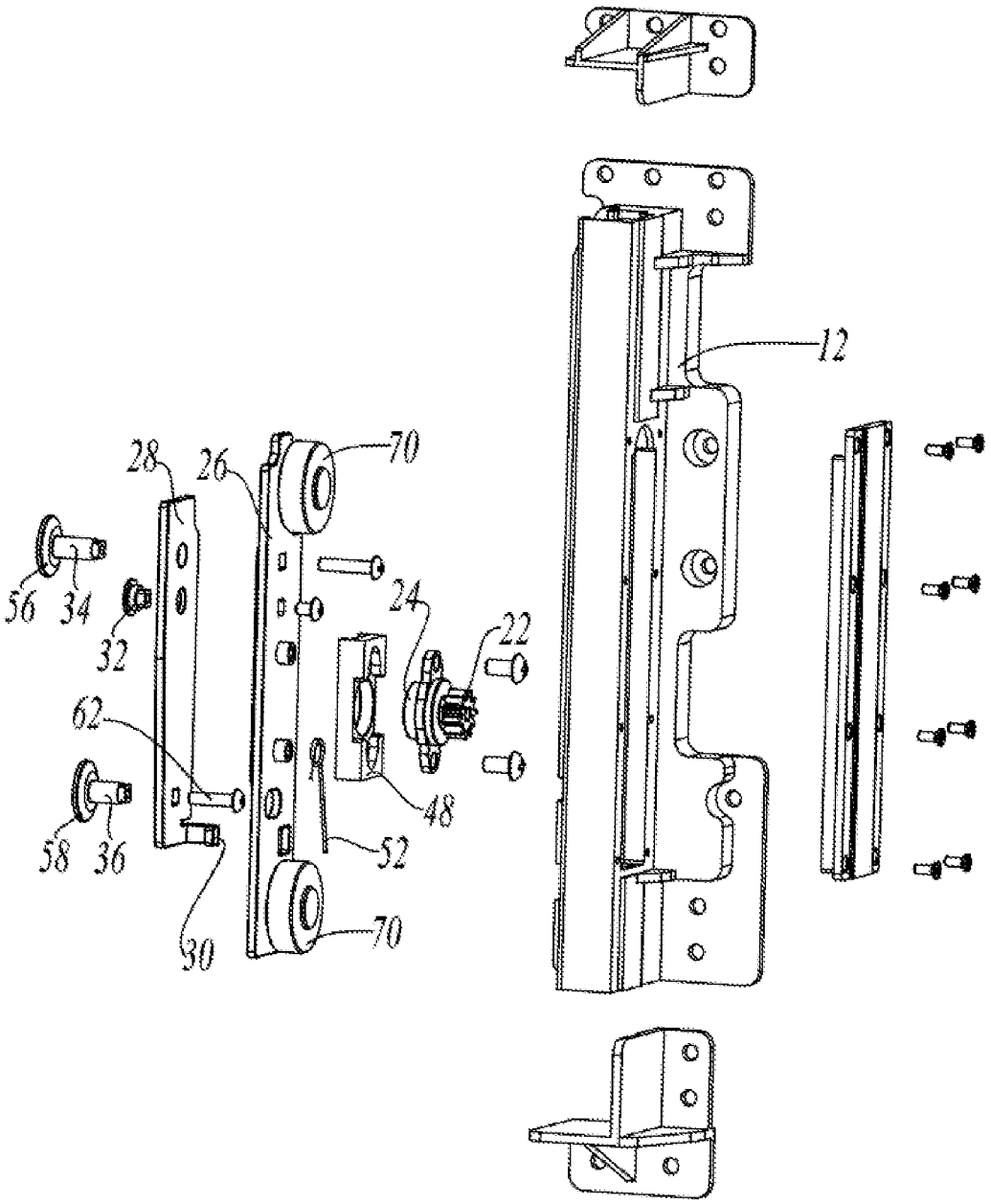
FIG. 8 is an exploded perspective enlarged view of a moving device and a slide rail of the shelf assembly in FIG. 7.
Figure 9:
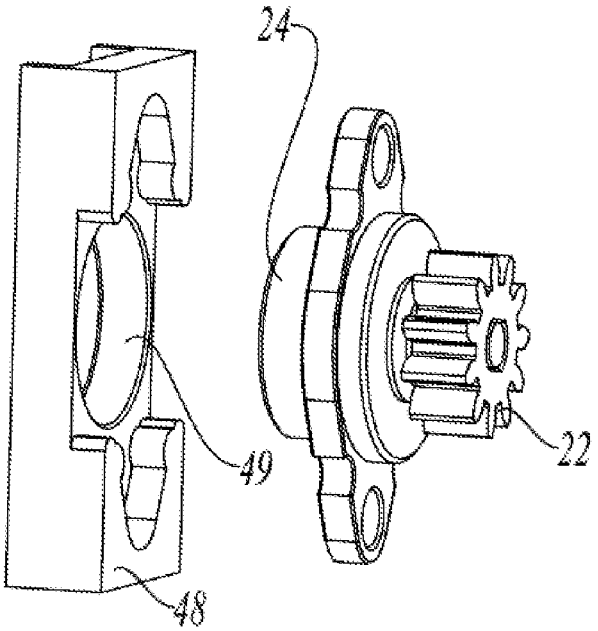
FIG. 9 is an exploded perspective enlarged view of a mounting base, a damper and a gear of the moving device in FIG. 8.
Figure 10:
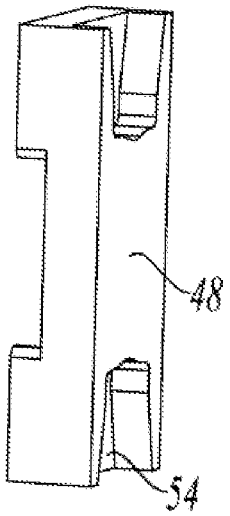
FIG. 10 is a perspective enlarged view of the mounting base in FIG. 9 as viewed in another direction.
Figure 11:
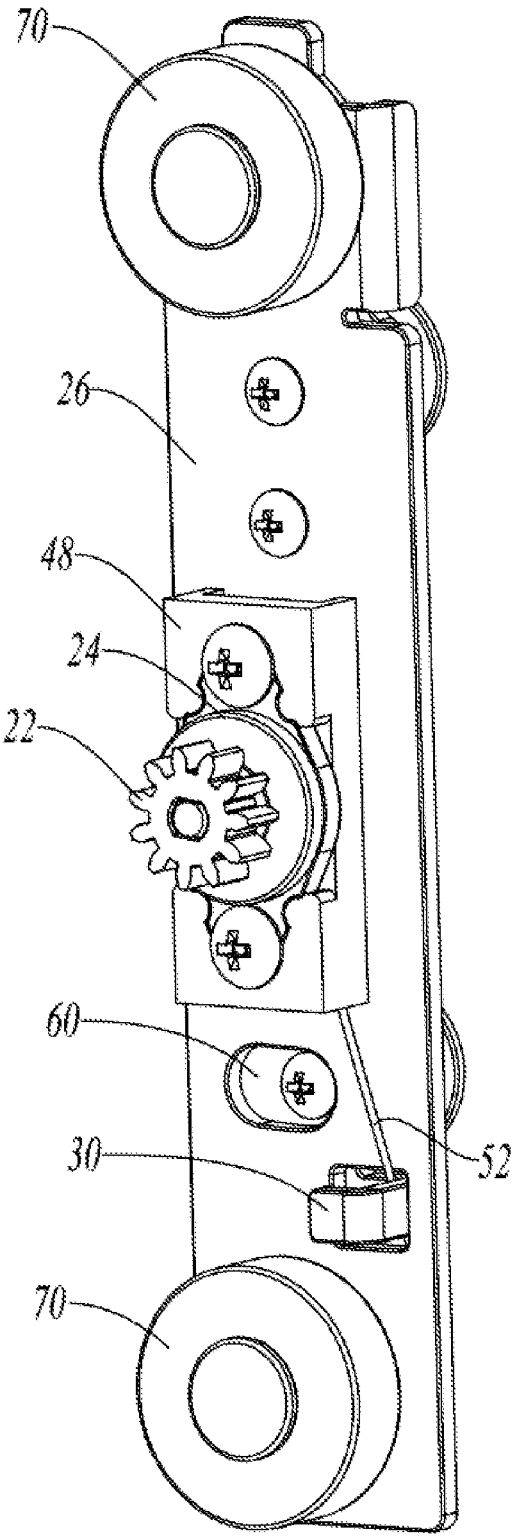
FIG. 11 is an enlarged perspective view of the moving device of the shelf assembly in FIG. 7.
Figure 12:
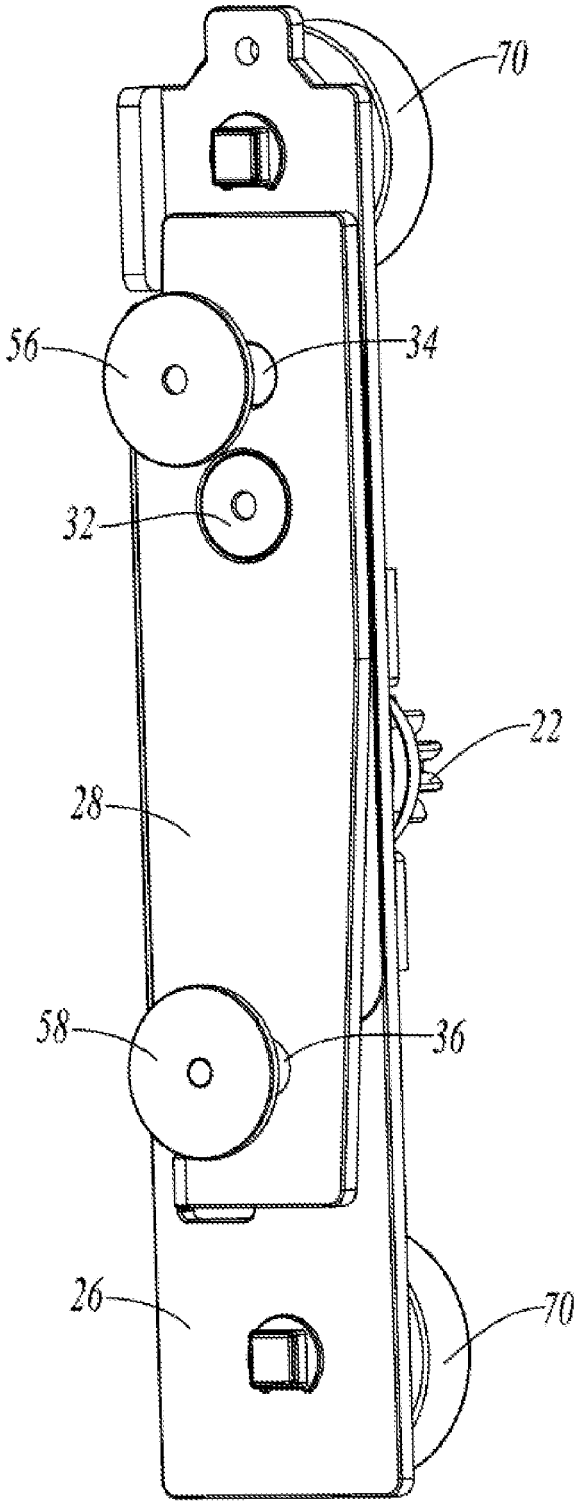
FIG. 12 is a perspective enlarged view of the moving device in FIG. 11 as viewed in another direction.
Figure 13:
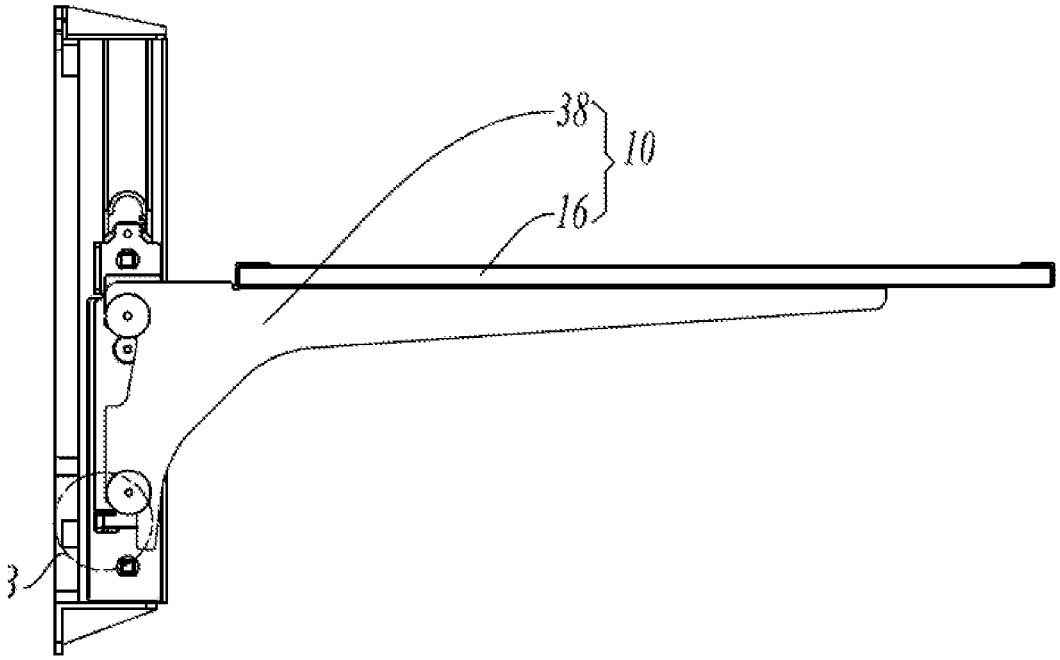
FIG. 13 is a right view of the shelf assembly in FIG. 3, whereupon a positioning member mates with a positioning portion.
Figure 14:
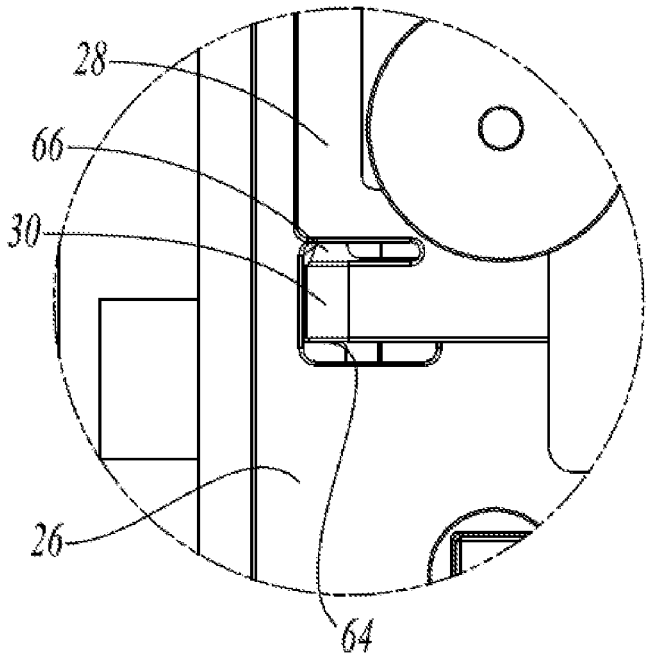
FIG. 14 is a partially enlarged view of position B in FIG. 13.
Figure 15:
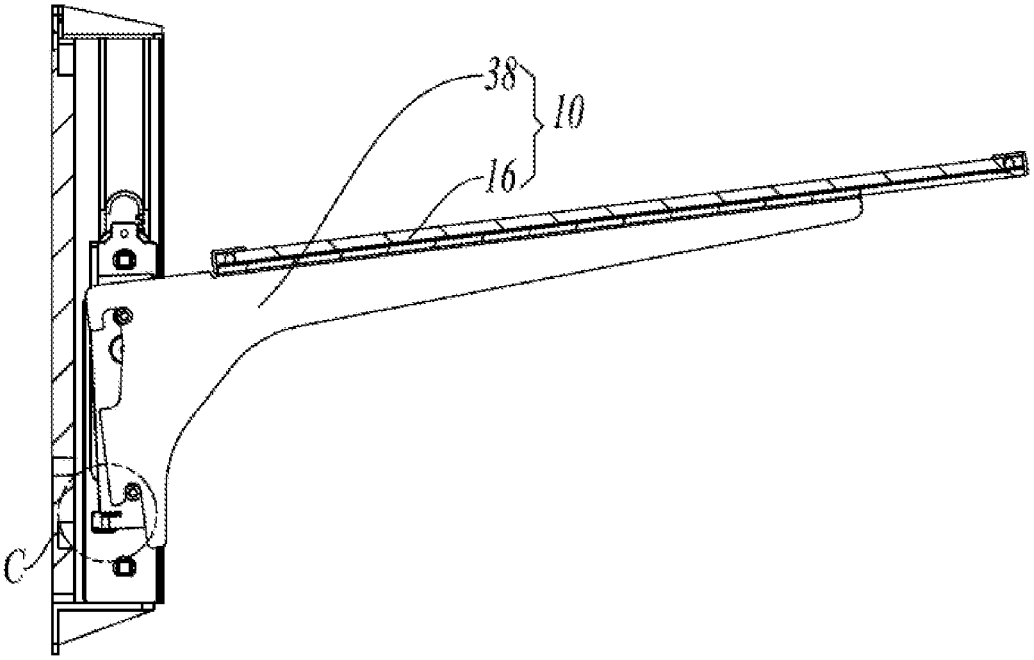
FIG. 15 is a right view of the shelf assembly in FIG. 3, whereupon a shelf device is lifted and inclined by a certain angle so that the positioning member is disengaged from the positioning portion.
Figure 16:
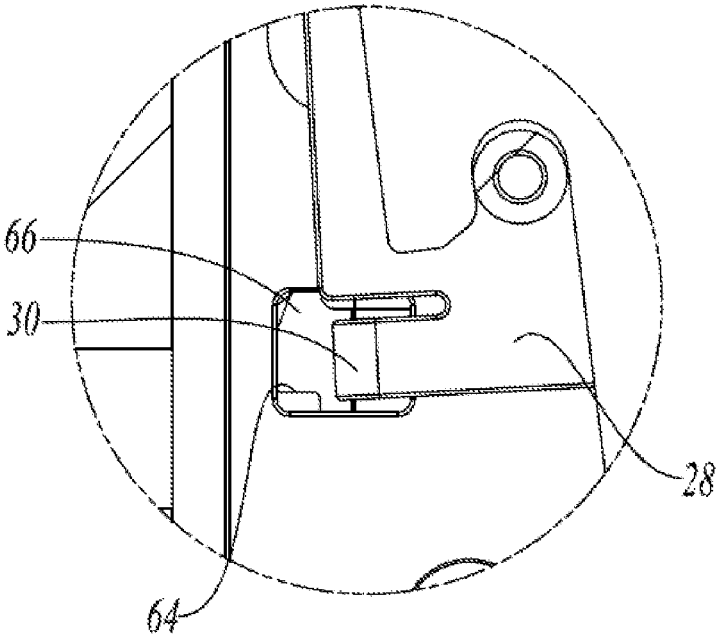
FIG. 16 is a partially enlarged view of position C in FIG. 15.
Figure 17:
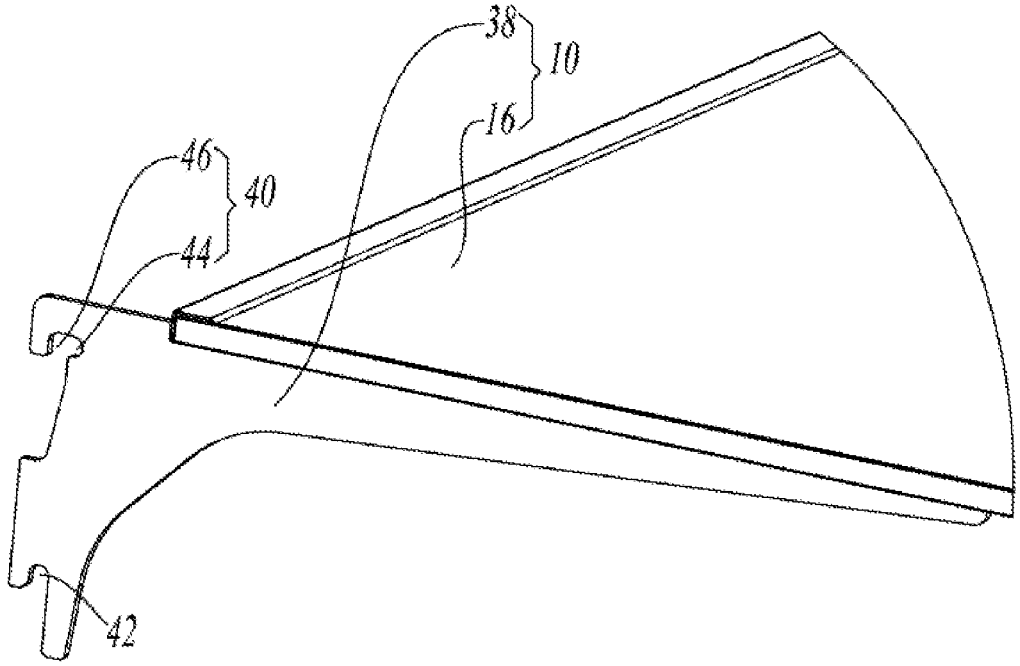
FIG. 17 is a partially enlarged perspective view of a shelf device in the shelf assembly in FIG. 3.
Figure 18:
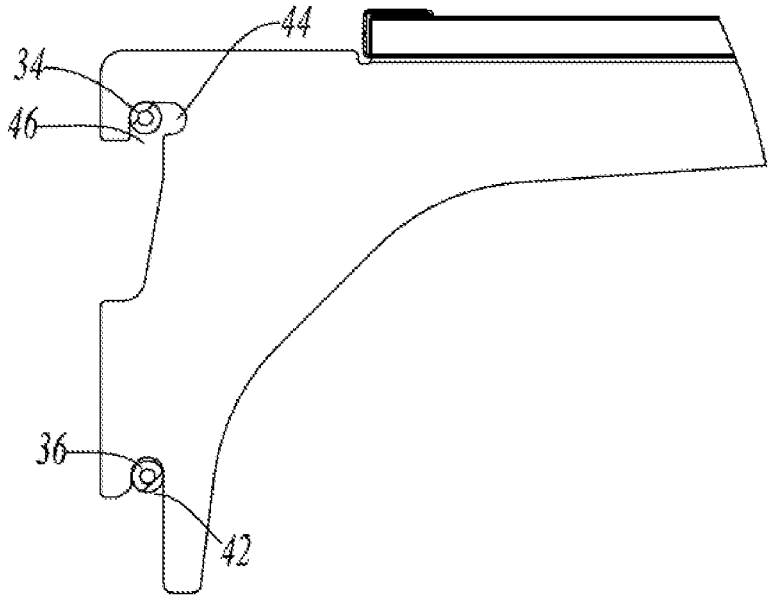
FIG. 18 is a view showing positional relationship between the shelf device and an upper hanger and a lower hanger in FIG. 17, whereupon the shelf device is an unoperated stated.
Figure 19:
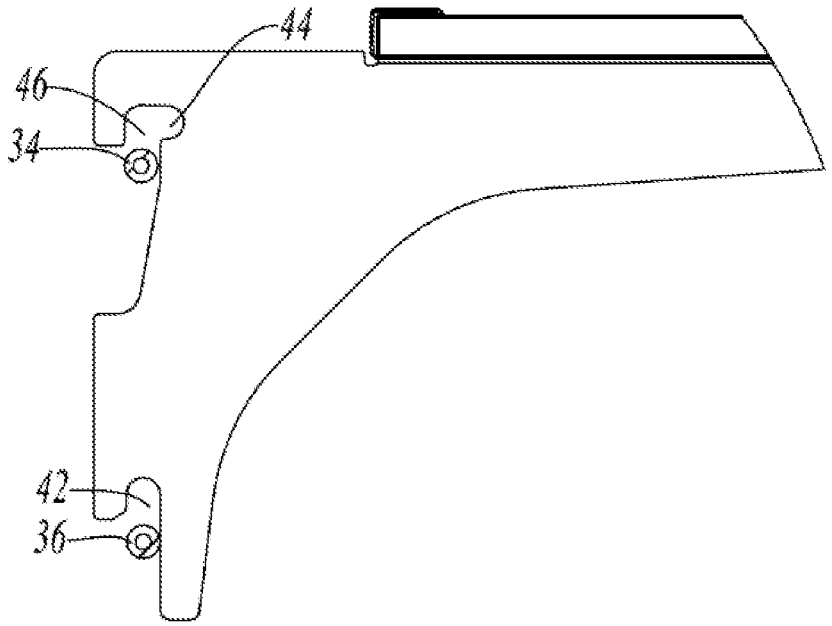
FIG. 19 is a view showing positional relationship between the shelf device and an upper hanger and a lower hanger in FIG. 18, whereupon the shelf device is lifted vertically by a certain height so that the shelf device is disengages from the upper hanger and lower hanger.

Referring further to FIG. 6 through FIG. 19, the shelf assembly further comprises a moving device 18 for supporting the shelf device 10. A height of the shelf device 10 in the vertical direction is operably adjusted. The slide rail 12 is provided with a rack 20 extending in the vertical direction. The moving device 18 comprises a gear 22 engaging with the rack 20 and a damper 24 that generates damping against the rotation of the gear 22 in one of the directions. When the moving device 18 moves downward, the damper 24 intervenes in damping to cause the moving device 18 to fall slowly. When the moving device 18 moves upward, the damper 24 does not intervene in damping. With the damper 24 generating one-way damping being provided, it is ensured that left and right sides of the shelf device 10 can move synchronously during upward movement and downward movement. Furthermore, the damper does not intervene in damping upon upward movement, the shelf device 10 can be moved upward more easily, thereby improving the user's experience effect. In addition, when the shelf device 10 and the moving device 18 move downward, the damper 24 intervenes in damping, increases resistance so that it cannot occur that the shelf device 10 slides downward fast in a free-fall manner, such that the shelf device 18 moves down slowly, and the user's experience in use can be improved.

The moving device 18 comprises a bearing plate 26 that is operably moved upward and downward relative to the slide rail 12, and a locking plate 28 rotatably disposed relative to the bearing plate 26. The gear 22 is rotatably disposed relative to the bearing plate 26, a positioning member 30 is disposed on the locking plate 28, and the locking plate 28 engages with the shelf device 10. When the shelf device 10 is operably lifted or released, a positioning member 30 is disengaged from or engaged with one of the positioning portions 14, to adjust the height of the shelf device 10. In order to make the adjustment and fixation of the shelf device 10 more stable, two slide rails 12 and two moving devices 18 are provided on both sides of the shelf device 10 respectively. Then, detailed depictions will be presented by taking the slide rail 12 and the moving device 18 on one side as an example.

In the preferred embodiment, when the shelf device 10 is lifted, the shelf device 10 is tilted upward at a certain angle, the locking plate 28 rotates relative to the bearing plate 26, so that the positioning member 30 is disengaged from the positioning portion 14, and then the shelf device 10 can be moved up or down to adjust the height. When the shelf device 10 is moved to a desired height, it will not be lifted again. As the shelf plate 16 returns to a horizontal state, the locking plate 28 rotates in a direction opposite to the above direction relative to the bearing plate 26, so that the positioning member 30 engages with the corresponding positioning portion 14, thereby locking the shelf device 10 at a certain height. Therefore, the adjustment of the shelf device 10 is simple and convenient, and the cost is low. During the adjustment of the height of the shelf device 10, the shelf device 10 and the moving device 18 are never disengaged from the slide rail 12, and the articles on the shelf device 10 needn't be removed, thereby achieving the adjustment of the load and avoiding the user's unnecessary trouble during use.

Specifically, the locking plate 28 is rotatably connected with the bearing plate 26 through a rotating shaft 32. The locking plate 28 is provided with an upper hanger 34 and a lower hanger 36. The shelf device 10 comprises a support 38. The support 38 is provided with an upper position-limiting hole 40 matting with the upper hanger 34 and a lower position-limiting hole 42 mating with the lower hanger 36. When the shelf device 10 is lifted, the support 38 drives the locking plate 28 to rotate so that the positioning member 30 is disengaged from the positioning portion 14. The support 38 is also set in a pair. The two supports 38 are fixedly connected with the shelf plate 16, the two supports 38 are symmetrically disposed on both sides of the shelf plate 16, and the support 38 is perpendicular to the shelf plate 16.

The upper position-limiting hole 40 comprises a horizontal portion 44 extending in a horizontal direction and a vertical portion 46 extending in a vertical direction. The horizontal portion 44 extends from the vertical portion 46 in a direction facing towards the user. The lower position-limiting hole 42 extends in the vertical direction. The upper position-limiting hole 40 and the lower positioning-limiting hole 42 both open downward. The opening of the upper position-limiting hole 40 is located at the vertical portion 46, and the vertical portion 46 of the upper position-limiting hole 40 is substantially located on the same vertical line as the lower position-limiting hole 42. When the shelf device 10 is in an unoperated state, namely, a released horizontal state, the upper hanger 34 is located at the vertical portion 46 of the upper position-limiting hole 40, and the lower hanger 36 is located at the lower position-limiting hole 42. When the shelf device 10 is detached, it is first lifted vertically and upwardly so that the upper hanger 34 is disengaged from the upper positioning-limiting hole 40 and the lower hanger 36 is disengaged from the lower position-limiting hole 42, and finally the shelf device 10 may be pulled outward horizontally and then detached, whereupon the moving device 18 is still on the slide rail 12. Therefore, the shelf device 10 can be detached very conveniently. When the shelf device 10 needed to cleaned, it may be detached individually.

The moving device 18 comprises a mounting base 48 fixedly connected to the bearing plate 26, the damper 24 is disposed on the mounting base 48, and a gear shaft of the gear 22 is connected to the damper 24. The damper 24 and the mounting seat 48 are fixedly connected to the bearing plate 26 through two bolts 50, and the damper 24 and the locking plate 28 are respectively located on both sides of the bearing plate 26. A groove 49 is disposed on a side of the mounting base 48 away from the bearing plate 26, and the damper 24 is at least partially received in the groove 49.

The moving device 18 further comprises an elastic member 52 that causes the positioning member 30 to engage with the positioning portion 14. In the present preferred embodiment, the elastic member 52 is set as a torsion spring. Certainly, the elastic member 52 may also be set as a tension spring, a compression spring or other elastic member 52. One end of the elastic member 52 is connected to the bearing plate 26 or the mounting base 48, and the other end of the elastic member 52 is connected to the positioning member 30. Furthermore, the mounting base 48 is provided with a receiving groove 54 facing the bearing plate 26, and the elastic member 52 is partially located in the receiving groove 54. In addition, the elastic member 52 is disposed on one of the bolts 50, so that the entire structure of the moving device 18 is made simpler and more compact.

When the height of the shelf device 10 is adjusted, the user holds a front side of the shelf device 10 to lift it up. Here, the front side of the shelf device 10 refers to the side of the shelf device 10 facing the user. As the user lifts the shelf device 10, the shelf device 10 inclines upward at a certain angle, the locking plate 28 rotates around the rotating shaft 32 relative to the bearing plate 26, the upper hanger 34 enters the horizontal portion 44 of the upper position-limiting hole 40, whereas the lower hanger 36 is always located in the lower position-limiting hole 42. After the locking plate 28 rotates by a certain angle with respect to the bearing plate 26, the positioning member 30 is disengaged from the positioning portion 14. At this time, the shelf device 10 may be moved up or down. At this time, the shelf device 10 and the moving device 18 together move up or down relative to the slide rail 12. After moving to the desired height, the shelf device 10 is no longer lifted. At this time, under the action of the elastic member 52, the locking plate 28 rotates in a direction opposite to the above direction relative to the bearing plate 26, so that the locating member 30 engages with the corresponding locating portion 14, thus locking the shelf device 10 at a certain height. At the same time, the upper hanger 34 engages with the vertical portion 46 of the upper position-limiting hole 40 again.

To make the installation of the shelf device 10 more stable and reliable, an upper stop 56 is disposed at an end of the upper hanger 34, a lower stop 58 is disposed at an end of the lower hanger 36, the support 38 is located between the upper stop 56 and the locking plate 28, and the support 38 is also located between the lower stop 58 and the locking plate 28.

Furthermore, a distance from the rotating shaft 32 to the lower hanger 36 is greater than the distance from the rotating shaft 32 to the upper hanger 34. The distance from the positioning member 30 to the rotating shaft 32 is greater than the distance from the lower hanger 36 to the rotating shaft 32, and the positioning member 30 is located at a lower end of the locking plate 28. According to the above arrangement, the positioning member 30 can disengaged from the positioning portion 14 in a way that the locking plate 28 rotates by a small angle. That is, when the height of the shelf device 10 is adjusted, the locating member 30 can be disengaged from the positioning portion 14 as long as the front side of the shelf device 10 is lift a small distance.

Specifically, in the present embodiment, a triangle is defined by a center of the rotating shaft 32, a center of the upper hanger 34 and a center of the lower hanger 36.

To make the rotation of the locking plate 28 more stable, the bearing plate 26 is provided with an arc-shaped guide hole 60, which guides the lower hanger 36. A guide pin 62 is disposed at an end of the lower hanger 36, and extends through the arc-shaped guide hole 60.

The positioning member 30 is an L-shaped bent member extending from the locking plate 28 towards a side of the locking plate 28. The bearing plate 26 is provided with a through hole, the positioning member 30 extends through the through hole, and the through hole is set to be square.

The number of the positioning portions 14 is set to seven, so that the shelf device 10 has seven adjusting positions. Certainly, the positioning portions 14 may also be set in other numbers. Specifically, the positioning portion 14 is set as a catching tooth which has a horizontal support portion 64 and a catching groove 66. When the shelf device 10 is fixed at a certain height position, the positioning member 30 is located in the catching groove 66 of the corresponding positioning portion 14, and the positioning member 30 is supported on the horizontal support portion 64 of the corresponding positioning portion 14. In addition, a circular arc transition 68 is disposed between two adjacent catching teeth, so that the positioning member 30 can easily enter the corresponding catching groove 66 and prevent the occurrence of false catching.

In order to make the adjustment of the height of the shelf device 10 more stable and easier, the moving device 18 further comprises two rolling bearings 70 located in the slideway. Preferably, both rolling bearings 70 employ noise-free bearings 70. As such, the resistance of the shelf device 10 in the adjustment process can be effectively reduce, the noise in the adjustment process be substantially reduced, and the comfort in the user's experience be improved.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art. The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A shelf assembly for a refrigerator, comprising:

a shelf device for placing articles;

a slide rail forming a slideway in a vertical direction, and having at least two positioning portions in a vertical direction;

wherein the shelf assembly further comprises:

a moving device for supporting the shelf device, the moving device comprising a bearing plate that is operably moved upward and downward relative to the slide rail, and a locking plate rotatably disposed relative to the bearing plate, a positioning member being disposed on the locking plate, the locking plate engaging with the shelf device; when the shelf device is operably lifted or released, a positioning member is disengaged from or engaged with one of the positioning portions, to adjust the height of the shelf device;

wherein the locking plate is rotatably connected with the bearing plate through a rotating shaft, the locking plate is provided with an upper hanger and a lower hanger, the shelf device comprises a support, and the support is provided with an upper position-limiting hole matting with the upper hanger and a lower position-limiting hole mating with the lower hanger; when the shelf device is lifted, the support drives the locking plate to rotate so that the positioning member is disengaged from the positioning portion.

2. The shelf assembly according to claim 1, wherein the upper position-limiting hole comprises a horizontal portion extending in a horizontal direction and a vertical portion extending in a vertical direction, the horizontal portion extends from the vertical portion in a direction facing towards the user, the lower position-limiting hole extends in the vertical direction, the upper position-limiting hole and the lower positioning-limiting hole are both set to be open-ended, and the upper position-limiting hole and the lower positioning-limiting hole both open downward.

3. The shelf assembly according to claim 1, wherein a distance from the rotating shaft to the lower hanger is greater than the distance from the rotating shaft to the upper hanger.

4. The shelf assembly according to claim 1, wherein a triangle is defined by a center of the rotating shaft, a center of the upper hanger and a center of the lower hanger.

5. The shelf assembly according to claim 1, wherein the bearing plate is provided with an arc-shaped guide hole, which guides the lower hanger.

6. The shelf assembly according to claim 1, wherein the moving device comprises two rolling bearings located in the slideway.

7. The shelf assembly according to claim 6, wherein the rolling bearings employ noise-free bearings.

8. A refrigerator, comprising a cabinet and a door body for opening/closing the cabinet, the cabinet comprising a housing and a liner, the liner defining a storage chamber, the refrigerator further comprising a shelf assembly according to claim 1 disposed on the liner;

the shelf device comprising a shelf plate for placing articles;

the slide rail being disposed on the liner.

9. A refrigerator, comprising a cabinet and a door body for opening/closing the cabinet, the cabinet defining a storage chamber, the refrigerator further comprising a shelf assembly according to claim 1 disposed on the door body;

the shelf device comprising a bottle seat for containing articles;

the slide rail being disposed on the door body.

10. The shelf assembly according to claim 1, wherein the slide rail is provided with a rack extending in the vertical direction, the moving device comprises a gear engaging with the rack and a damper that generates damping against the rotation of the gear in one of the directions;

when the moving device moves downward, the damper intervenes in damping to cause the moving device to fall slowly;

when the moving device moves upward, the damper does not intervene in damping.

11. The shelf assembly according to claim 10, wherein the moving device comprises a mounting base fixedly connected to the bearing plate, the damper is disposed on the mounting base, and a gear shaft of the gear is connected to the damper.

12. The shelf assembly according to claim 11, wherein the damper and the mounting seat are fixedly connected to the bearing plate through two bolts, and the damper and the locking plate are respectively located on both sides of the bearing plate.

13. The shelf assembly according to claim 12, wherein a groove is disposed on a side of the mounting base away from the bearing plate, and the damper is at least partially received in the groove.

14. The shelf assembly according to claim 11, wherein the moving device further comprises an elastic member that causes the positioning member to engage with the positioning portion.

15. The shelf assembly according to claim 14, wherein one end of the elastic member is connected to the mounting base, and the other end of the elastic member is connected to the positioning member.

16. The shelf assembly according to claim 15, wherein the mounting base is provided with a receiving groove facing the bearing plate, and the elastic member is partially located in the receiving groove.

17. The shelf assembly according to claim 1, wherein the moving device further comprises an elastic member that causes the positioning member to engage with the positioning portion.

18. The shelf assembly according to claim 17, wherein one end of the elastic member is connected to the bearing plate, and the other end of the elastic member is connected to the positioning member.

* * * * *